US005913997A

United States Patent [19]

Schulz et al.

[11] Patent Number: 5,913,997

[45] Date of Patent: Jun. 22, 1999

[54] PROCESS FOR THERMOMECHANICALLY TREATING A FLEECE WEB MADE OF THERMOPLASTIC SYNTHETIC RESIN AND AN APPARATUS FOR CARRYING OUT THE PROCESS

[75] Inventors: Herbert Schulz, Troisdorf; Bernd Kunze, Hennef, both of Germany

[73] Assignee: Reifenhauser GmbH & Co. Maschinenfabrik, Troisdorf, Germany

[21] Appl. No.: 08/737,384

[22] PCT Filed: Jul. 20, 1996

[86] PCT No.: PCT/DE96/01371

§ 371 Date: Oct. 31, 1996

§ 102(e) Date: Oct. 31, 1996

[87] PCT Pub. No.: WO97/05312

PCT Pub. Date: Feb. 13, 1997

[30] Foreign Application Priority Data

Jul. 25, 1995 [DE] Germany ..... 195 27 057

[51] Int. Cl.[6] ..... B32B 31/00

[52] U.S. Cl. ..... 156/229; 156/290; 156/494; 156/496; 156/497; 156/553

[58] Field of Search ..... 156/62.4, 167, 156/180, 181, 229, 82, 290, 494, 496, 497, 553; 264/210.8, 290.2, 290.5

[56] References Cited

U.S. PATENT DOCUMENTS 3,855,045 12/1974 Brock ..... 428/198
3,949,128 4/1976 Ostermeier ..... 428/152
5,730,821 3/1998 Joest et al. ..... 156/167

FOREIGN PATENT DOCUMENTS

A 0 127 483 12/1984 European Pat. Off. .
A 2 081 057 11/1971 France .
A 2 348 301 11/1977 France .
A 2 078 271 1/1982 United Kingdom .

*Primary Examiner*—James Sells
*Attorney, Agent, or Firm*—Herbert Dubno

[57] ABSTRACT

A process for the thermomechanical treatment of a fleece web which is comprised of filaments and/or fibers of a thermoplastic synthetic resin in a continuous process. The fleece web is moved during the thermal treatment continuously and with uniform speed. The fleece web passes initially a thermal treatment station and in this is traversed by a gas stream of predetermined gas flow velocity and gas flow temperature and is heated to a preheating temperature. The preheated fleece web is subjected to mechanical treatment. The gas flow temperature and the gas flow velocity on the one hand and the treatment stretch of the fleece web in the thermal treatment station on the other are so selected that the preheating temperature at all speeds which can be assumed by the fleece web, including zero speed, does not exceed the temperature of the melting point of the filaments and/or the fibers. Also apparatus for carrying out the process of the invention are given.

18 Claims, 3 Drawing Sheets

PROCESS FOR THERMOMECHANICALLY TREATING A FLEECE WEB MADE OF THERMOPLASTIC SYNTHETIC RESIN AND AN APPARATUS FOR CARRYING OUT THE PROCESS

CROSS REFERENCE TO RELATED APPLICATION

This application is a national phase of PCT/DE96/01371 filed Jul. 20, 1996 and based in turn on German national application 19527057.6 of Jul. 25, 1995 under the International Convention.

FIELD OF THE INVENTION

The invention relates to a process for the thermomechanical treatment of a fleece web which is comprised of filaments and/or fibers of thermoplastic synthetic resin, in a continuous procedure.

Filaments are characterized in the sense of the invention as of theoretically endless length individual synthetic resin threads which are formed into a nonwoven fleece whereby the individual filaments are united together at the crossover locations and contact locations in a material-to-material junction. Such fleece webs are also known as spun bond. Fibers are characterized, by contrast, as short fiber-shaped synthetic resin elements which are generated for example with the aid of the melt-blown technique and form a melt-blown fleece whose fibers are also united at the crossing locations in a material-to-material junction. The fleece web can be formed as a monolayer or can be multilayered and formed from a plurality of individual fleece webs.

Processes for the thermomechanical treatment of a fleece web, which is comprised of filaments and/or fibers of thermoplastic synthetic resin, are known in various embodiments. A common thermomechanical treatment is so-called bonding. Under this designation it is understood that the fleece web is simultaneously provided with point weld locations which have a predetermined weld point diameter and a predetermined uniform grid pattern distributed over the fleece web. As a result the filaments or fibers are not completely welded, i.e. do not form small plates simultaneously with one another. The weld points result in a structure different from that of small plates in that the filaments and/or fibers at the weld points have at least a recognizable texture. Such weld points also are referred to as bonding points.

The bonding effects an increase in the strength of the fleece web. To bring about a defined increase of the strength, all of the point weld locations must practically have the same geometry and must structure and be uniformly distributed over the length and breadth. The bonding is effected according to the state of the art at least directly in conjunction with the fleece formation in the apparatus for producing such fleece and, indeed, with the aid of bonding point embossing rolls which are heated. There is no special influence of the temperature with which the fleece web is fed to the bonding. The resulting bonding can be improved with reference to the uniformity. Also, the quality of the bonding cannot be readily matched to different operating conditions, for example, for different synthetic resins or web thicknesses or filament diameter or fiber diameter.

Another customary thermomechanical treatment is the stretching of the finished fleece web in the length direction and/or transverse direction with the aid of corresponding stretching units stretching also. The stretching as well results in an increase in the strength. Stretching must also be carried out uniformly in the sense of the above requirements. In conjunction with such stretching, it is known to preheat the fleece web before it is fed to the stretching unit or while it is in the stretching unit, usually with the aid of infrared radiators. Even this known feature can stand improvement, especially with reference to the matching to the different operating conditions.

OBJECTS OF THE INVENTION

It is an object of the invention to provide a process with which in a simple way in the described sense a very uniform thermomechanical treatment which is matched to different operating conditions of a fleece web of filaments and/or fibers of thermoplastic synthetic resins is possible.

SUMMARY OF THE INVENTION

This object is attained in accordance with the invention in a continuous process for thermomechanical handling of a fleece web which is comprised of filaments and/or fibers of thermoplastic synthetic resin in a continuous process, with the combination of the following features:

- the fleece web is moved at a uniform speed continuously during the thermomechanical treatment,
- the fleece web passes initially a thermal treatment station and is preheated therein by a gas stream of a given gas flow velocity and gas flow temperature, and is thus heated to the preheating temperature, and
- the preheated fleece web is subjected to the mechanical treatment.

The gas flow temperature and the gas flow velocity on the one hand and the treatment stretch of the fleece web in the thermal treatment station on the other hand are so chosen that the preheating temperature at all speeds which the fleece web can assume, including zero velocity, does not exceed the melting point of the filament and/or the fibers. The fleece web is moved at a constant speed which lies in a range which is customary today in the production or treatment of a fleece web of thermoplastic synthetic resin. The process of the invention covers all these speeds. It should be understood that the thermomechanical treatment is effected over the width and length of the fleece web uniformly.

The invention is based upon the discovery that, with a gas stream which traverses the fleece web, a very uniform preheating of the fleece web is possible and, in conjunction therewith, a very uniform thermomechanical treatment of the fleece web is possible and, indeed, simultaneously through and through the latter. The determinant, according to the invention, is that the gas flow temperature and the gas flow velocity on the one hand and the treatment stretch of the fleece web in the thermal treatment station on the other hand are so selected that the preheating temperature at all speeds which can be assumed by the fleece web in operation including zero speed, is such that the temperature does not exceed the melting point of the filaments and/or fibers. This assures reliability that the fleece web will not be subjected to any damage in the thermal treatment station but rather the subsequent mechanical treatment will be optimized. Preferably the operation of the thermal treatment station is so carried out that the preheating temperature coincides with the gas flow temperature.

In this manner, the preheating temperature can be controlled or regulated with very high precision. This allows, further, a simple matching to different operating conditions, for example, in reference to different thermoplastic synthetic resins, different specific basis weights of the fleece web, etc., The parameters can always be so selected that in the fleece web, the melting temperature of the filaments or fibers is not exceeded, even when the gas flow temperature is higher than the melting temperature. If the gas flow temperature is less than the melting temperature, even with a simultaneously endlessly long-term treatment of a fleece segment in the thermal treatment station, the melting point will not be achieved. Interruptions in processing are thus thereby managed. The preheating temperature is measured upon leaving the thermal treatment station.

In its details, the invention can provide a number of possibilities for the further development and form of the process. Thus, the fleece web can be forwarded through the thermal treatment station on a fluid-permeable transport belt through which the gas stream is passed from above to below through the web. There is also the possibility of feeding the fleece web in the thermal treatment station between two permeable transport belts which can be traversed from above downwardly as well as from below upwardly. The fleece web can be traversed by the gas stream successively from above downwardly or from below upwardly or in the opposite sequence by the gas stream. Further, the fleece web in the same place or at the same time in the thermal treatment station can be traversed by a gas stream and the two gas streams can be directed against one another.

In accordance with a preferred embodiment of the invention, the preheated fleece web is provided with bonding points in the mechanical treatment. For this purpose, the preheated fleece web in the mechanical treatment can be passed between heated bonding point embossing rolls equipped with the bonding points, a cooling being then excluded. The fleece web can, however, also be subjected to a stretching in the longitudinal direction and/or in the transverse direction in the mechanical treatment and can thereafter be cooled. In accordance with a preferred embodiment of the invention, the preheated fleece web is first provided with bonding points in the mechanical treatment and thereafter subjected to a stretching in the longitudinal direction and/or the transverse direction.

In the framework of the invention it is possible to carry out the aforedescribed matching, as has already been emphasized, so that the gas flow temperature and the gas flow velocity on the one hand and the treatment stretch of the fleece web in the thermal treatment station on the other hand are so selected that the preheating temperature at all speeds which can be assumed by the fleece web in operation including zero velocity, matches the gas flow temperature. The invention allows the gas flow temperature, the gas flow velocity and the treatment stretch of the fleece web in the thermal treatment station to be matched for different thermoplastic synthetic resins and/or different fleece web production rates. In the framework of the invention, an air stream can be used as the gas stream. Preferably one works with a dry air stream as the gas stream. Depending upon the synthetic resin used and the temperature it is recommended to operate with an oxygen-free gas stream. As the gas stream, also water vapor or a mixture of the water vapor and air can be used. Should condensation arise in the fleece web, it is recommended to connect a drying stage downstream.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
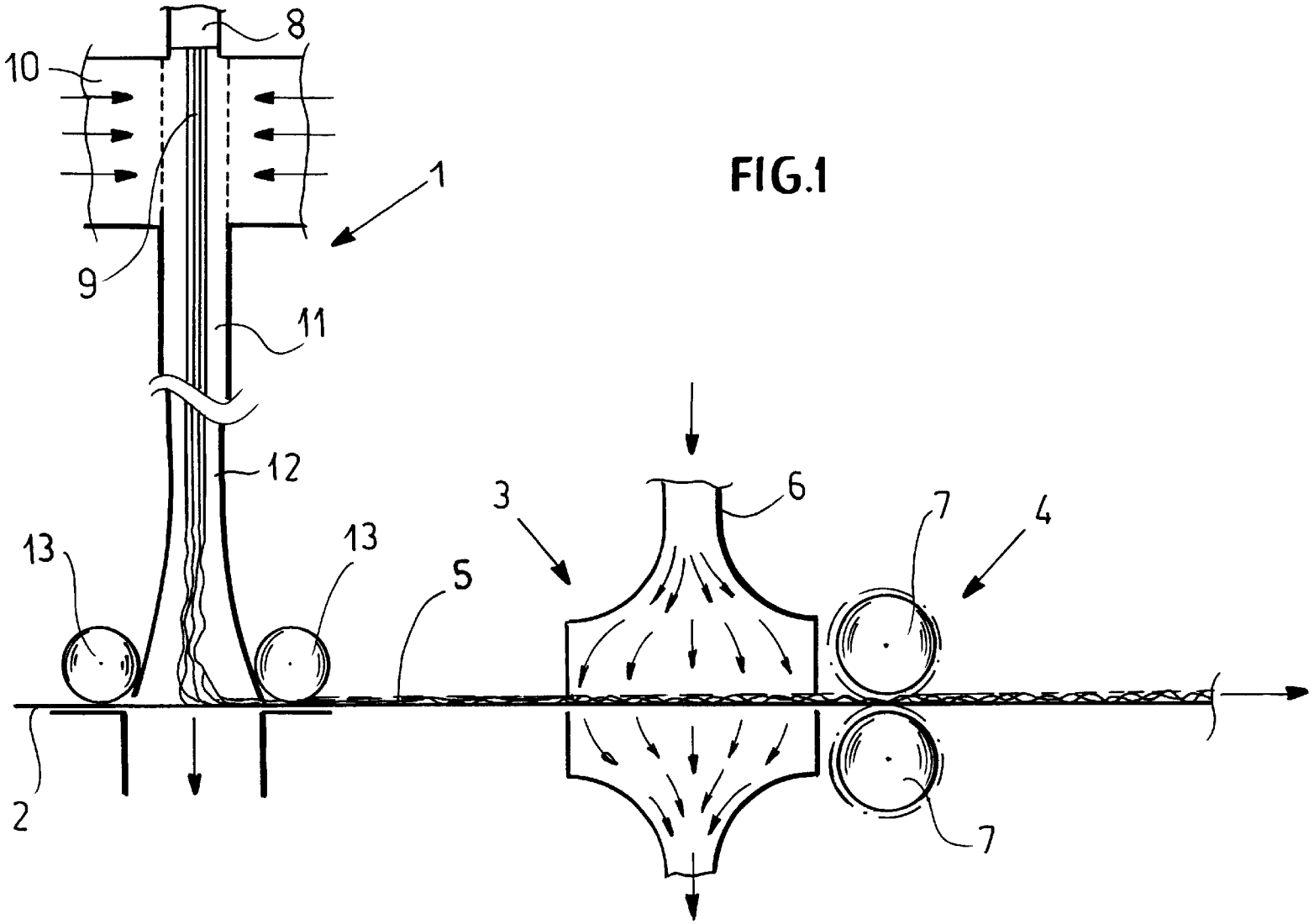
FIG. 1 is a diagram of an apparatus for carrying out the process according to the invention with a device for bonding the fleece web.

The apparatus shown in FIG. 1 for carrying out the process of the invention comprises in its basic configuration a fleece-forming unit 1, an endlessly circulating transport belt 2, a thermal treatment station 3 and a mechanical treatment station 4.

The endlessly circulating transport belt 2 is configured to take up the fleece web 5 upon its formation and as well as for transporting away the formed fleece web. The thermal treatment station 3 for the formed fleece web 5 comprises devices 6 for passing a gas stream with predetermined gas flow velocity and gas flow temperature through the fleece web 5. The flow is signified by arrows in FIG. 1. The mechanical treatment station 4 serves, in the embodiment of FIG. 1, to provide the fleece web 5 with bonding points. For this purpose, the mechanical treatment station is equipped with bonding rolls 7. The fleece web 5 is fed on the transport belt 2 through the thermal treatment station 3 and the mechanical treatment station 4.

The fleece-forming unit 1 comprises a spinnerette 8 to which thermoplastified synthetic resin prepared in the usual manner is fed. From the spinnerette 8 emerge corresponding filaments 9. The filaments pass a cooling station 10 and enter into a so-called stretching shaft 11 to which a diffuser 12 is connected. The rollers 13 fulfill a sealing function and enable the process air to be drawn off in the direction of a bolt arrow. The roller 13 and the right-hand side in the Figure presses the formed fleece web 5, in addition, against the transport belt 2 which is guided over a corresponding support. The circulation path of the transport belt 2 has not been indicated.

The thermal treatment station 3 is aerodynamically so configured that a highly uniform thermal treatment of the fleece web 5 in the transverse direction is effected and so that also in the longitudinal direction of the fleece web 5 there are no disturbing locations or singularities. The mechanical treatment station 4 operates as has already been indicated with bonding rolls 7. The fleece web 5 leaves the thermal treatment station 3 at the temperature thereof, i.e. with a preheating temperature which lies below the melting temperature of the filaments or fibers and is fed to the mechanical treatment station 4 with this temperature.

Figure 2:
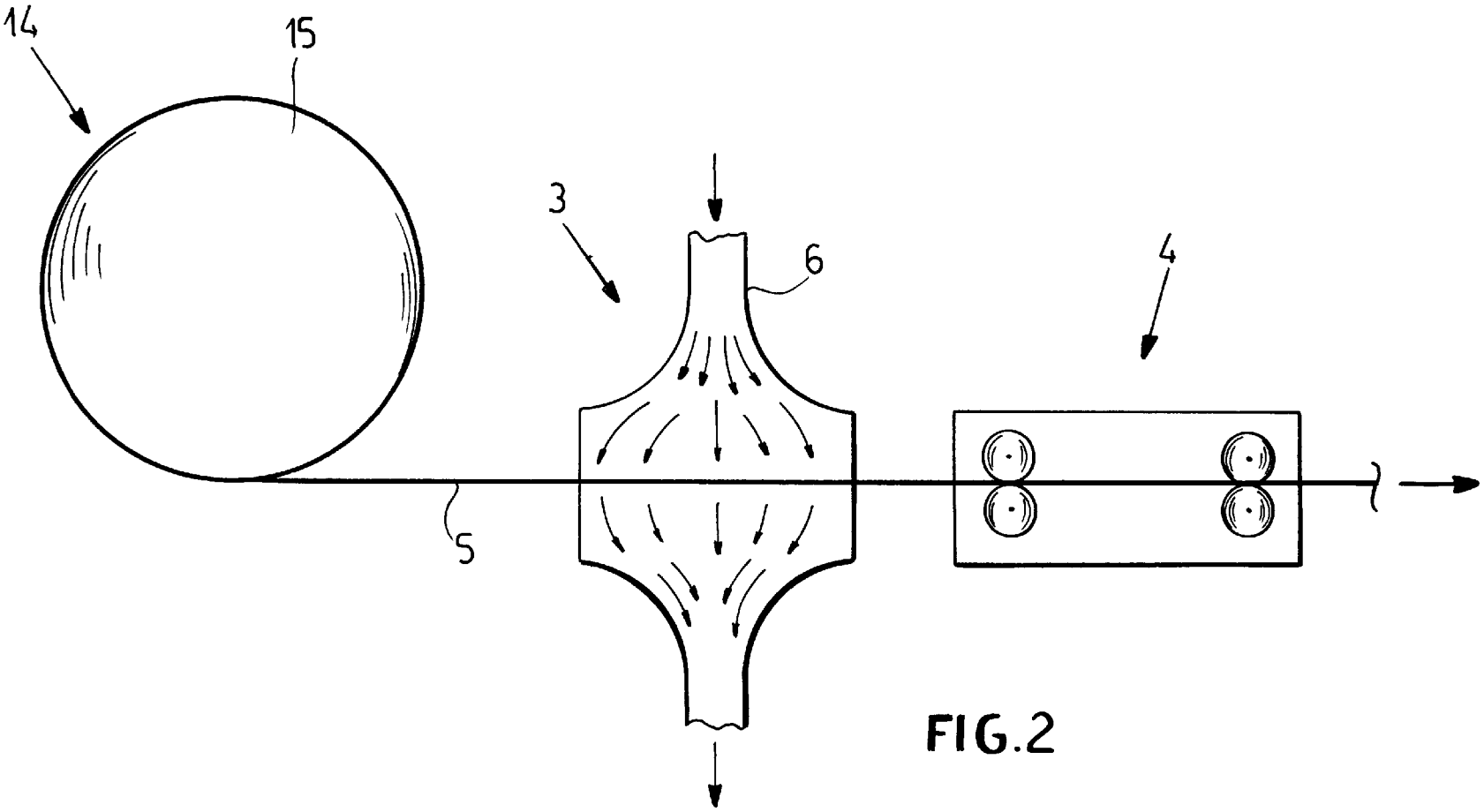
FIG. 2 is a diagram of an apparatus for carrying out the process of the invention with a device for stretching the fleece web.

Contrary thereto, FIG. 2 shows an apparatus for carrying out the process of the invention which comprises a fleece web cooling station 14, a thermal treatment station 3 for the fleece web 5 and a mechanical treatment station 4, whereby the mechanical treatment station 4 serves as a stretching unit. The fleece web 5 wound on a coil 15 is produced at some other location and may have been fabricated at some other time. For the thermal treatment station 3, a unit as has already been described is used. The mechanical treatment station 4 is connected to the thermal treatment station 3 with the consequence that the fleece web 5 at the preheating temperature is directly fed into the stretching unit whereby stretching in the longitudinal direction and/or the transverse direction can be undertaken. The fleece web 5 can previously be provided with bonding points as has been clarified with respect to FIG. 1. It retains its structure upon stretching when processed according to the process of the invention.

Figure 3A:
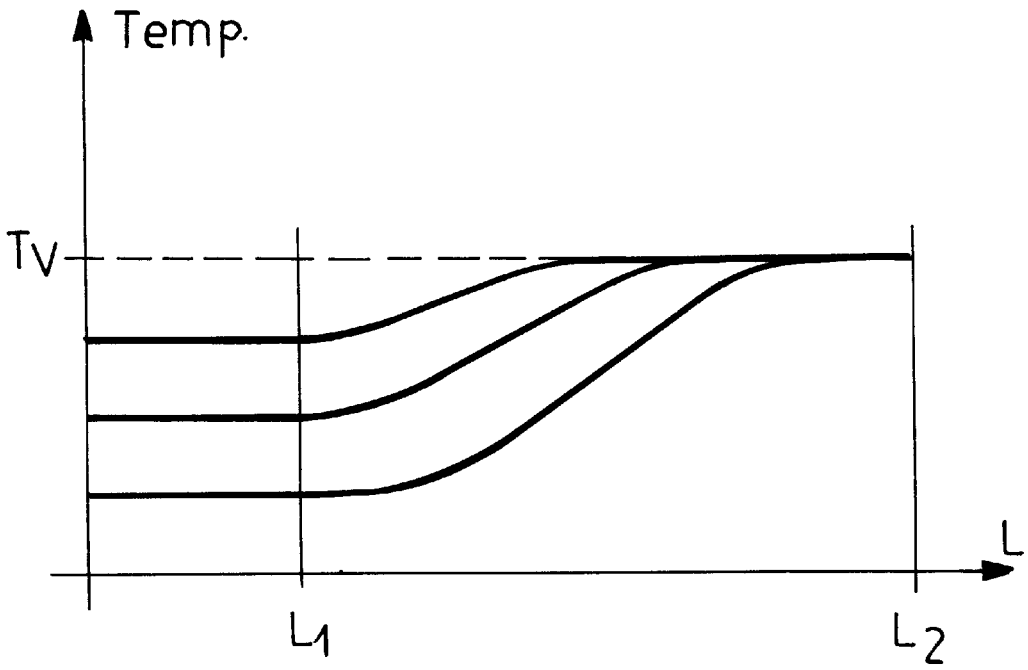
FIGS. 3*a* and 3*b* are graphic illustrations for explaining the process of the invention.
Figure 3B:
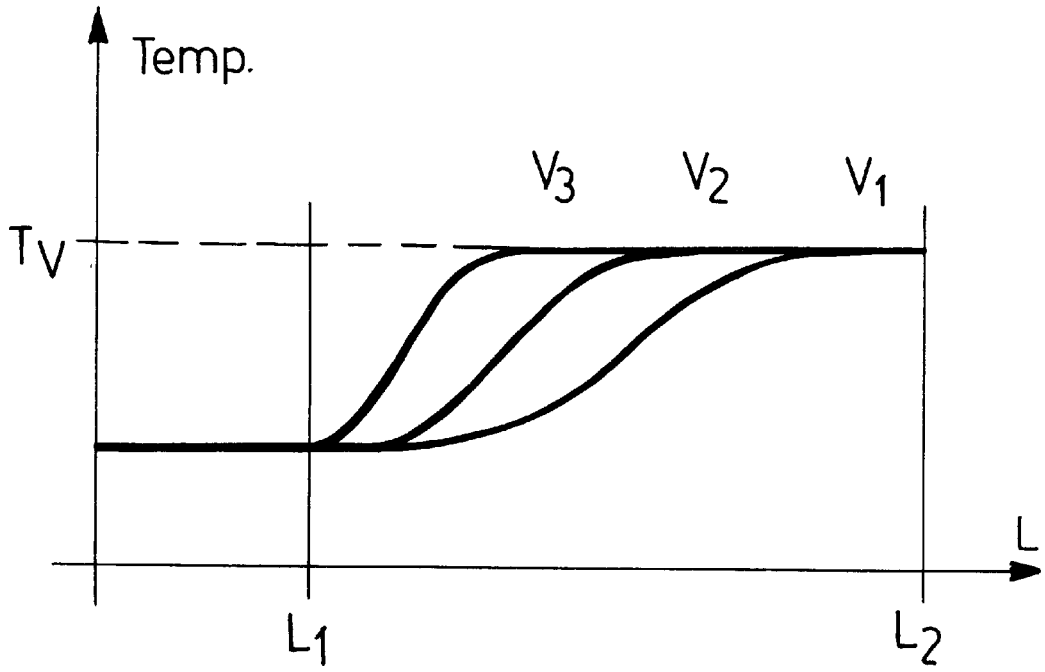

In FIGS. 3*a* and 3*b* one can see graphic illustrations, plotted against the temperature along the ordinate axis, of the length of the treatment stretch plotted along the abscissa axis, over which the thermal treatment is effected for the fleece web in the thermal treatment station 3 and indeed over which the fleece web 5 is traversed by the gas stream for the thermal treatment.

In FIGS. 3*a* and 3*b* the treatment stretch lies between $L_1$ and $L_2$. The fleece web 5 may be fed to the thermal treatment station 3 at three different inlet temperatures as represented in graphical illustration in FIG. 3*a*. In all three cases, the transport velocity of the fleece web 5 is the same and constant. One can see in FIG. 3*a* that the fleece web 5 is brought to a preheating temperature $T_v$ in the thermal treatment station which can be the same in all three cases and which is constant. To that extent, a constant preheating is attained even when the inlet temperatures of the fleece web can be different.

In FIG. 3*b*, the treatment stretch for the fleece web is again represented along the abscissa axis and corresponds to the stretch from $L_1$ and $L_2$. In the embodiment of FIG. 3*b*, the fleece web can be displaced at different speeds $V_1$, $V_2$ and $V_3$ but with a constant inlet temperature through the thermal treatment station. Here as well, the treatment station ensures that the outlet temperature and thus the preheating temperature $T_v$ of the fleece web 5 will be the same even when, as will be apparent from FIG. 3*b*, the fleece web 5 leaves the fleece-forming station in which it may have been stopped as a consequence of operating failure. It will be self-understood that one can vary the length of the treatment stretch in the thermal treatment station.

We claim:

1. A process for a thermomechanical treatment of a fleece web which is comprised of filaments and/or fibers of thermoplastic synthetic resin in a continuous process, said process comprising the steps of:

(a) moving the fleece web continuously for the thermomechanical treatment and with uniform speed;

(b) initially passing the fleece web while it is moved continuously through a thermal treatment station and passing through said web in said station a gas stream of predetermined gas flow velocity and gas flow temperature to thereby heat said web to a preheating temperature; and (c) subject the preheated fleece web to the mechanical treatment, the gas flow temperature and the gas flow velocity on the one hand and the treatment stretch of the fleece web in the thermal treatment station on the other hand being so selected that the preheating temperature at all speeds which the fleece web can assume in operation, including the speed zero, the preheating temperature does not exceed the melting point of the filaments and/or the fibers.

2. The process according to claim 1 whereby the fleece web is moved at a constant speed during treatment in said station which corresponds to a conventional web processing speed.

3. The process according to claim 1 wherein the fleece web is traversed by the gas stream from above downwardly in the thermal treatment station on a permeable transport belt.

4. The process according to claim 1 wherein the fleece web is fed in the thermal treatment station between two permeable transport belts and is traversed by the gas stream from above downwardly and from below upwardly.

5. The process according to claim 4 wherein the fleece web is traversed in succession from above downwardly and from below upwardly or in the reverse order by the gas stream.

6. The process according to claim 4 wherein the fleece web is traversed by a gas stream at the same place and at the same time in the thermal treatment station.

7. The process according to claim 4 wherein the preheated fleece web is provided with bonding points in the mechanical treatment.

8. The process according to claim 1 wherein the preheated fleece web is provided with bonding points between two heated bonding point embossing rolls in the mechanical treatment.

9. The process according to claim 1 wherein the preheated fleece web is subjected to a stretching in a longitudinal direction and a stretching in the transverse direction in the mechanical treatment and is thereafter cooled.

10. The process according to claim 1 wherein the fleece web is initially provided with bonding points in the mechanical treatment and thereafter is subjected to a stretching in a longitudinal and in a transverse direction.

11. The process according to claim 1 wherein the gas flow temperature and the gas flow velocity on the one hand and the treatment stretch of the fleece web in the thermal treatment station are so selected that the preheating temperature at all velocities which can be assumed in operation by the fleece web including zero velocity, practically coincides with the gas flow temperature.

12. The process according to claim 1 wherein the gas flow temperature, the gas flow velocity and the treatment stretch of the fleece web in the thermal treatment station is matched to different thermoplastic synthetic resins and different fleece web products.

13. The process according to claim 1 wherein the gas stream is an air stream.

14. The process according to claim 1 wherein a dry air stream forms the gas stream.

15. The process according to claim 1 wherein said gas stream is an oxygen-free gas stream.

16. An apparatus for a thermomechanical treatment of a fleece web, comprising:

a fleece-forming unit for producing a fleece web;

an endlessly circulating transport belt for receiving the fleece web and for transporting the fleece web away from said fleece-forming unit;

a thermal treatment station along said belt including a device for passing through the fleece web a gas stream of predetermined gas flow velocity and gas flow temperature; and a mechanical treatment station along said belt with bonding rolls for point bonding of fibers of the fleece, the fleece web being guided on the transport belt through the thermal treatment station and the mechanical treatment station, whereby the gas flow temperature lies below the melting temperature of the fibers.

17. The apparatus according to claim 16 wherein in the longitudinal direction of the transport belt downstream of the mechanical treatment station with said bonding rolls, a stretching unit is arranged into which the fleece web is fed, the transport belt being fed back to the fleece-forming unit ahead of said stretching unit.

18. An apparatus for a thermomechanical treatment of a fleece web comprising:

a fleece web coil station for delivering a fleece web;

a thermal treatment station for the formed fleece web with a device for passing through the fleece web a gas stream of predetermined gas flow velocity and gas flow temperature; and a mechanical treatment station in the form of a stretching unit receiving the fleece web from said thermal treatment station whereby the fleece web is fed into the stretching unit practically with the preheating temperature established in the thermal treatment station.

* * * * *